US011866922B2

(12) United States Patent
Grody

(10) Patent No.: US 11,866,922 B2
(45) Date of Patent: Jan. 9, 2024

(54) PROGRAMMABLE TOILET FLUSH INITIATING, MONITORING AND MANAGEMENT SYSTEM AND METHOD THEREOF

(71) Applicant: Hydraze, Inc., Potomac, MD (US)

(72) Inventor: Charles Dylan Grody, Potomac, MD (US)

(73) Assignee: HYDRAZE, INC., Potomac, MD (US)

( * ) Notice: Subject to any disclaimer, the term of this patent is extended or adjusted under 35 U.S.C. 154(b) by 539 days.

(21) Appl. No.: 16/745,140

(22) Filed: Jan. 16, 2020

(65) Prior Publication Data

US 2021/0222416 A1 Jul. 22, 2021

(51) Int. Cl.
*E03D 5/10* (2006.01)
*E03D 5/12* (2006.01)

(52) U.S. Cl.
CPC ..... *E03D 5/105* (2013.01); *E03D 5/10* (2013.01); *E03D 5/12* (2013.01)

(58) Field of Classification Search
CPC ..... E03D 5/105; E03D 5/10
See application file for complete search history.

(56) References Cited

U.S. PATENT DOCUMENTS 1,875,983 A * 9/1932 Bourdet ..... E03D 5/10 4/406
2,688,141 A * 9/1954 Filliung ..... E03D 5/10 4/305
4,692,951 A 9/1987 Taki et al.
6,018,827 A 2/2000 Shaw et al.
7,028,374 B2 4/2006 Fiocco
7,177,725 B2 2/2007 Nortier et al.
7,814,582 B2 10/2010 Reddy et al.
8,695,125 B2 4/2014 Funari et al.
9,447,625 B1 9/2016 Seebaransingh et al.
10,941,552 B2 3/2021 Grody
2002/0162166 A1 11/2002 Saar et al.
2005/0171709 A1 8/2005 Nortier et al.
2006/0130223 A1 6/2006 Yen
(Continued)

FOREIGN PATENT DOCUMENTS

GB 2165271 A 4/1986
GB 2488071 A 8/2012
(Continued)

OTHER PUBLICATIONS

International Search Report and Written Opinion issued in the counterpart PCT Application PCT/US2019/014115, dated Apr. 9, 2019 (No. of pages.15).
(Continued)

*Primary Examiner* — Janie M Loeppke
(74) *Attorney, Agent, or Firm* — Burns & Levinson LLP; Joseph P. Quinn

(57) ABSTRACT

The present invention relates to a toilet flushing initiating, monitoring and management system initiated by the unlocking of a locking member on a door mounted in a stall typically found in a bathroom such as a public bathroom. Signal patterns from flushing controller and a door housing controller are recorded and analyzed to identify associated fault conditions. Notifications of the associated fault conditions are output and communicated to an authorized user, such as a facilities manager.

16 Claims, 9 Drawing Sheets

(56) References Cited

U.S. PATENT DOCUMENTS

| | | | | |
|---|---|---|---|---|
| 2008/0072369 | A1 | 3/2008 | Funari et al. | |
| 2009/0119142 | A1 | 5/2009 | Yenni et al. | |
| 2012/0317709 | A1 | 12/2012 | Oates | |
| 2014/0020166 | A1 | 1/2014 | Metcalf et al. | |
| 2014/0264110 | A1 | 9/2014 | Wilson et al. | |
| 2015/0233146 | A1 | 8/2015 | Klevens et al. | |
| 2017/0051486 | A1 | 2/2017 | Schomburg et al. | |
| 2018/0066422 | A1 | 3/2018 | Allard, III | |
| 2018/0135285 | A1 | 5/2018 | Canfield et al. | |
| 2019/0089550 | A1 * | 3/2019 | Rexach | A47G 29/08 |
| 2019/0226190 | A1 | 7/2019 | Grody | |

FOREIGN PATENT DOCUMENTS

| | | | |
|---|---|---|---|
| JP | H0729074 | U | 6/1995 |
| JP | H09221805 | A | 8/1997 |
| JP | 2006177064 | A | 7/2006 |
| JP | 2012022367 | A | 2/2012 |
| JP | 2013072261 | A | 4/2013 |
| JP | 2014214594 | A | 11/2014 |
| JP | 2018009289 | A | 1/2018 |
| JP | 2019141306 | A | 8/2019 |
| KR | 930000595 | Y1 | 2/1993 |
| WO | 2017031473 | A | 2/2017 |
| WO | 2019143879 | A1 | 7/2019 |

OTHER PUBLICATIONS

International Search Report and Written Opinion issued in the counterpart PCT Application PCT/US2020/013866, dated Oct. 1, 2020 (No. of pages.12).

Decision to Grant in Japanese Application No. 2020-560878 dated May 16, 2023 (3 pages).

International Preliminary Report on Patentability in Application No. PCT/US2019/014115, dated Aug. 6, 2020 (10 pgs.).

Office Action in JP Application No. 2020-560878, dated Nov. 4, 2022 with English translation (11 pgs.).

Notice of Submission of Opinion in Korean Application No. 10-2020-7022913 dated May 30, 2023 [English translation], 7 pages.

Communication pursuant to Article 94(3) EPC in Application No. 19703565.2 dated Jul. 19, 2023 (5 pages).

* cited by examiner

PROGRAMMABLE TOILET FLUSH INITIATING, MONITORING AND MANAGEMENT SYSTEM AND METHOD THEREOF

TECHNICAL FIELD OF THE INVENTION

The present invention relates to a system for managing toilet flushing and monitoring wastewater consumption in toilets, for example, toilets in bathroom stalls, typically found in locations that accommodate a large number of people such as but not limited to airports, college campus buildings, public buildings, sports arenas, and entertainment events.

BACKGROUND

Public bathrooms such as those found in offices, schools, airports, and parks, for example, have toilets located in stalls to maintain privacy for the user. Users typically lock the stall door following entry and unlock the stall door upon exit.

In toilets designed to serve a large number of people, there are two standard types of toilet flushing mechanisms: manual flushing such as a toilet handle, lever, or button and automatic flushing initiated by a sensor and an automated flushing mechanism.

In manual flushing, toilets have a handle, lever, or button that is actuated manually and is operably joined to a flushing mechanism that flushes the toilet when actuated. This method relies entirely on the user to intentionally cause the toilet to flush which can be problematic for locations where high sanitation standards are required. Users are often not motivated to flush the toilet because, for example, flushing requires extra time and effort or risks contamination of the user to produce a consequence that to the user is personally insignificant.

To mitigate the problem in which users fail to flush, many facilities have installed automatic flush toilets. Automatic flush toilets typically have infrared or ultrasonic sensors that detect the distance between the user and the toilet. When the user enters the stall and then leaves moving away from the toilet, a sensor detects that a predetermined distance between user and toilet is met, and the sensor triggers the toilet to flush.

Automatic toilet flushing systems are very popular and are even required in certain places. These systems keep toilets clean and reduce the incidence of germ transfer and the possibility of transmitting transmissible diseases. Disadvantageously, automatic flushing toilets sometimes do not flush enough or, more commonly, flush too often. Actions such as hanging up a coat, placing down a backpack, or lining a seat with toilet paper may cause the user to unintentionally or unnecessarily trigger the automatic toilet flushing sequence. Extra flushes, particularly for toilets in public bathrooms that may be used hundreds or even thousands of times in a day, can accumulate significantly over time and create a significant amount of water waste.

SUMMARY OF THE INVENTION

The primary advantage of the present invention is water saving by significantly more accurately determining when the toilet should be flushed and the frequency with which the toilet has been used compared to the currently existing automatic toilet flushing systems. Prior art systems measure the user's distance from the toilet, which is not an effective predictor of when and if the user has used the toilet due to errors in determining whether a user has actually used the toilet or is engaged in some unrelated behavior as discussed above. The best indicator of toilet use and water consumption is the unlocking of the toilet stall door to open the door so that the user may exit the stall. Because the present invention is based on the reliability of the user to unlock the stall door as the sole indicator that the toilet has been used, the invention uses the stall door unlocking action to determine when to flush the toilet. Accordingly, because no other user behavior initiates any unintentional flush, the likelihood that the toilet will flush and flush only once, as necessary, for each toilet use is improved. Not only is the level of sanitation of the toilet improved compared to existing systems, the number of unnecessary flushes resulting in excessive and undesirable water waste use is markedly limited.

A second key advantage of the present invention is that flushing does not require the user to be inconvenienced. Because users almost always lock and unlock the stall door to maintain privacy, by modifying the locking-unlocking steps to trigger the toilet to flush, the toilet will flush as the user leaves the toilet stall without any additional effort on the part of the user.

Optionally, a sign may be added to the inside or outside of the stall door informing the user that the toilet has been equipped to flush automatically when the stall door is unlocked thereby avoiding or reducing inadvertent manual flushing by the user.

A third key advantage of the present invention is that it includes the same sanitary benefits associated with sensor based automatic toilet flushing systems.

According to one aspect, the invention relates to a system for managing toilet flushing in a bathroom stall. The system comprises a door locking member, a toilet flushing controller and a toilet flushing actuator.

In one embodiment of the invention, the door locking member of the system includes a door lock chamber, typically attached to a stall post, a slider typically attached to the stall door and aligned with the door lock chamber, a housing enclosing a signal emitter associated with the door locking member, the signal emitter configured to send a wireless signal to a flush signal receiver associated with a toilet flushing mechanism comprising a toilet flushing controller and a toilet flushing actuator. The locking member further includes a sensor for sensing the position of the slider, a door housing controller for receiving input from the sensor and initiating the sending of a signal by the signal emitter to the flush signal receiver, and one or more batteries and an SD card enclosed in the housing typically having a cover. The door housing controller further can optionally regulate the function of the batteries and SD card. The SD card can store data received from the door housing controller optionally including without limitation sensor input and signal emitter output.

The slider is capable of translating from a first position to a second position and comprises a first, or proximal end, and an opposite second, or distal end. In the slider first position the slider first end is inserted in the door lock chamber and in the second position the slider first end is positioned outside of, i.e., is free of, the door lock chamber. The stall door cannot open unless the slider is in the second position. The sensor is configured for sensing the slider when the slider is in the second position, and is operatively connected to the signal emitter, communicating the detected position of the slider to the door housing controller. The door housing controller triggers the signal emitter to send a signal to the flush signal receiver. The toilet flushing controller is operatively joined to the flush signal receiver.

The toilet flushing actuator is controlled by the toilet flushing controller.

The signal emitter is configured to transmit to the flush signal receiver a signal, e.g., a Bluetooth® or radio frequency signal, upon sensing the signal sent from the sensor to the door housing controller that the sensor has detected that the slider has been translated to the second position, the toilet flushing controller configured to control the flushing actuator to initiate a single flush when the stall door is unlocked.

In one embodiment, the system further comprises a system controller configured to set intervals of time between 5 seconds to 240 seconds during which a flush can be activated. The system controller is capable of communicating with both the door housing controller and the toilet flushing controller wirelessly or through hardwire connection. The system controller is capable of setting the duration of flushing intervals for all toilets in the bathroom and/or the duration of flushing intervals for all toilets in a building and may be configured to prevent any toilet from flushing for a period of 5-240 seconds after its previous flush.

In another embodiment according to the invention, the system further comprises a toilet handle, lever, or button for manually flushing the toilet, and/or one or more photovoltaic cells or batteries for energizing one or more of the sensor, door housing controller, signal emitter, flush signal receiver, toilet flushing controller, and toilet flushing actuator.

In another aspect, the invention relates to a method for managing toilet flushing in a bathroom stall. In one embodiment, the method includes receiving a wireless signal from a signal emitter in a stall door latch, the wireless signal indicating a retraction of the slider in the stall door locking member and triggering a flushing actuator to initiate flushing of a toilet in response to receiving the wireless signal.

In another embodiment, the method for managing toilet flushing in a bathroom stall includes sensing a retraction of a stall latch slider by a sensor; and emitting a wireless signal by a signal emitter in response to sensing the retraction by the slider, wherein the wireless signal is matched to a flush signal receiver. This method may further include receiving the wireless signal by the flush signal receiver and triggering a flushing actuator by a toilet flushing controller in communication with the flush signal receiver in response to the receiving of the wireless signal by the flush signal receiver.

In still another embodiment, the method for managing toilet flushing in a bathroom stall comprises providing a device comprising a door locking member comprising a slider having a first end and a second end opposite the first end, a signal emitter, and a sensor, a flush signal receiver; a toilet flushing controller; and, a toilet flushing actuator. Additionally the method includes transmitting by the signal emitter to the flush signal receiver, a signal upon the detection of the position of the second end of the slider by the sensor, controlling the toilet flushing actuator by the toilet flushing controller, initiating by the toilet flushing controller a single toilet flush by the toilet flushing actuator when the slider second end position is detected by the sensor; and, optionally, recording the frequency of slider operation by a door housing controller onto the SD card.

DESCRIPTION OF THE INVENTION

Definitions

Figure 1A:
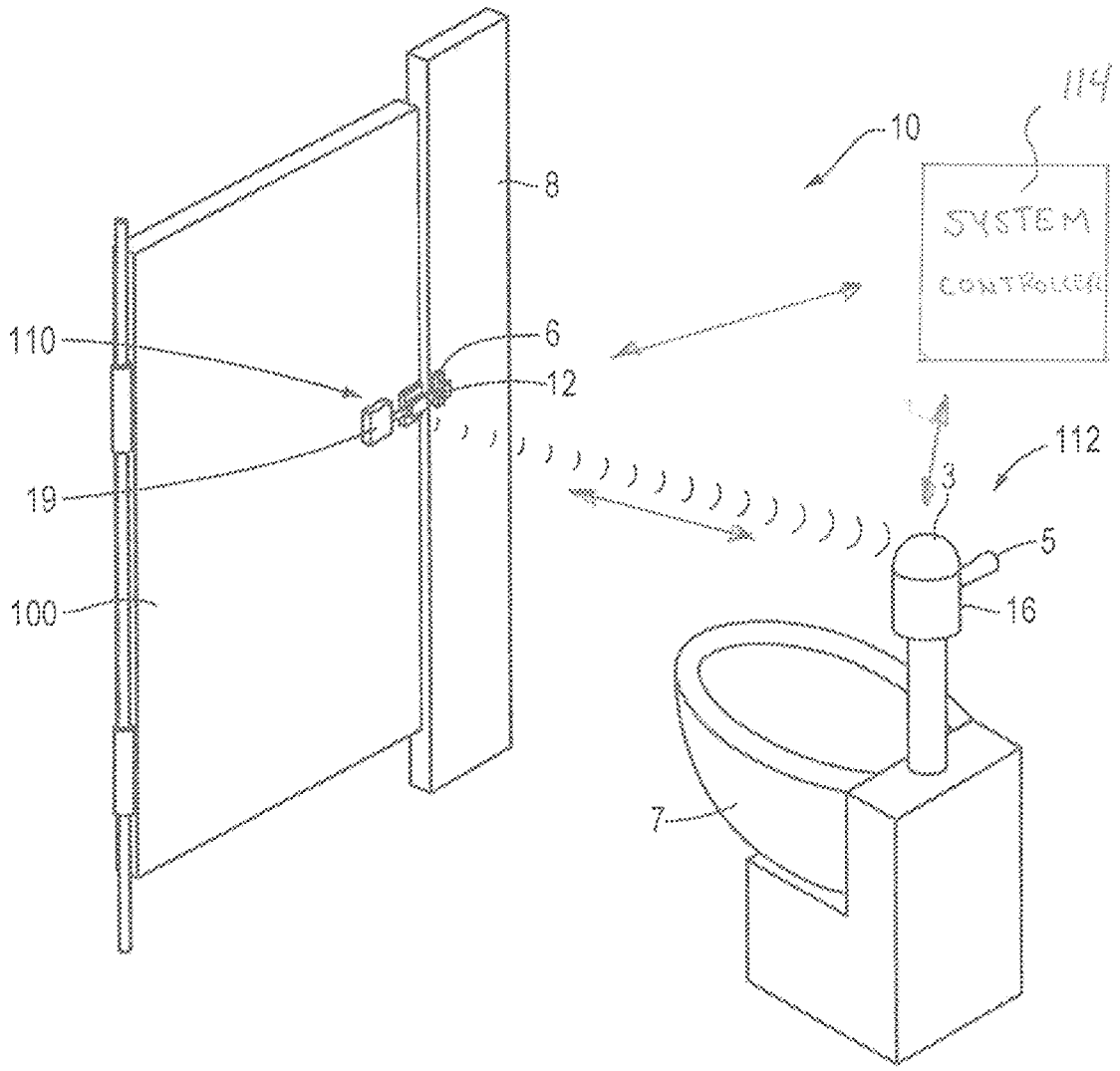
FIG. 1A illustrates an embodiment of the automatic toilet flushing system according to the invention.

The following listing comprises exemplary non-limiting definitions of certain terms used throughout the present description:

Door Locking Member: Components involved in the stall latch mechanism.

Slider: Mechanism that the user uses to lock and unlock the stall door. A slider is typically attached to the stall door and aligned with a door lock chamber.

Door Locking Chamber: Component used to secure the slider in the locked position.

Housing: Receptacle attached to the stall door that contains the sensor, signal emitter, door housing controller, batteries, battery holder, sd card, and has a cover with photovoltaic cells.

Sensor: Senses the position of the slider.

Door Housing Controller: Microcontroller for all of the components within the housing. Regulates the function of the sensor and signal emitter.

Signal Emitter: Sends wireless signal from the housing to the flush signal receiver.

Cover: Covers door locking member components within housing and can be location for photovoltaic cells.

Toilet Flushing Mechanism: A system for flushing the toilet that contains the toilet flushing controller, toilet flushing actuator, flush signal receiver, and toilet handle/lever/button.

Toilet Flushing Actuator: Executes the operation of an automatic flush.

Flush Signal Receiver: Receives a signal from the signal emitter.

Toilet Flush Controller: Controls when the toilet flushing actuator initiates a flush.

Computer: A laptop, desktop, tablet, or smart device with which a facility manager can view signals from the system controller as well as signal to the system controller to initiate certain actions.

System Controller: A central component of the overall system that receives signals from the door housing controller, toilet flushing controller, and computer, and can also signal the door housing controller and toilet flushing controller to perform flushing actuation, regulate time delays between flushes for one toilet, all toilets in a bathroom, or toilets in an entire building the system controller also can be used to determine and vary flush water volumes. The system controller can be an independent module or integrated into the computer through hardware or software Feedback loop: An occurrence where the door housing controller and toilet flushing Controller emit a signal to the System Controller that an action has been completed, along with an indicator for the action that has been completed (i.e. the toilet has flushed), the date, time, and battery life are recorded.

Usage Cycle: Process of the user entering the stall, using the toilet, then leaving the stall. While there are multiple possibilities of what could happen during this cycle (i.e., the user does a manual flush or the latch unlocking causes a flush). Each usage should have these three steps in this exact order. This means that the system controller should expect to receive information first from feedback loop 1, then feedback loop 2, then feedback loop 3 in that exact order, for every use. If information received is from the feedback loops out of order, or if there is an absence of information from one or multiple loops, then that could indicate that a component is malfunctioning.

Time bucket: An interval of time that can range of one hour, to one day, to one week, to one month, to one year, to multiple years. A time bucket can be an arbitrary block of time, or an interval between set times.

"x" and "y": Placeholders or variables that indicate values that can be programmed into the system.

Opt-out Button: An additional component to the door locking member that a user could press to prevent an automatic flush (for example, if the user only uses the stall to change clothes, and did not need the toilet to flush).

Distance Sensor: A sensor used to actuate a flush based on the user's distance from the automatic toilet. This is the primary method for automatic flushing with existing technology, frequently using infrared technology. In this application, it is an optional and additional method of determining when to flush.

The present solution without sacrificing user functionality or convenience addresses drawbacks such as too few or too many flushes characteristic of current toilet flushing mechanisms. The present solution is a device and a method thereof that initiates a toilet flushing sequence by the unlocking of a toilet stall door.

As used herein, a stall may be any walled enclosure with or without a roof or ceiling having a door and any number of sides that will provide sufficient privacy to the typical toilet user to encourage its use and may be any shape including but not limited to rectangular, pyramidal, cylindrical, and trapezoidal.

The invention disclosed herein is directed to a toilet flush management system and an automated toilet flushing system that does not require manual flushing of a toilet. Manual flushing of a toilet is an option that can be included with the present invention.

FIGS. 1A-1D illustrate the toilet flushing management system. The overall scheme of the toilet flushing management system 10 is illustrated in FIG. 1A. The system 10 includes a stall door locking member 110 affixed to the door 100 of a stall housing a toilet 7, hereinafter toilet stall.

The system 10 further includes a toilet flushing mechanism 112 comprising a flush signal receiver 3, a flush actuator 5 and a toilet flushing controller 16 associated with the toilet flushing actuator 5 for initiating a flush by the toilet 7.

Figure 1B:
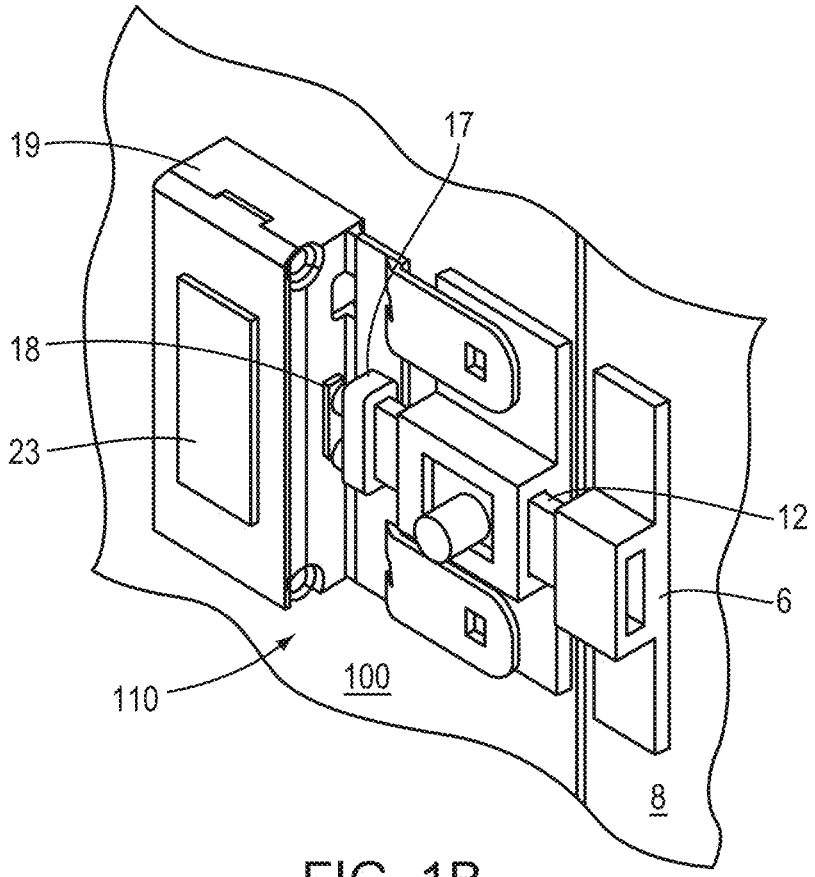
FIG. 1B is an illustrative isometric view of one embodiment of the stall door locking mechanism illustrated in FIG. 1 according to the invention.
Figure 1C:
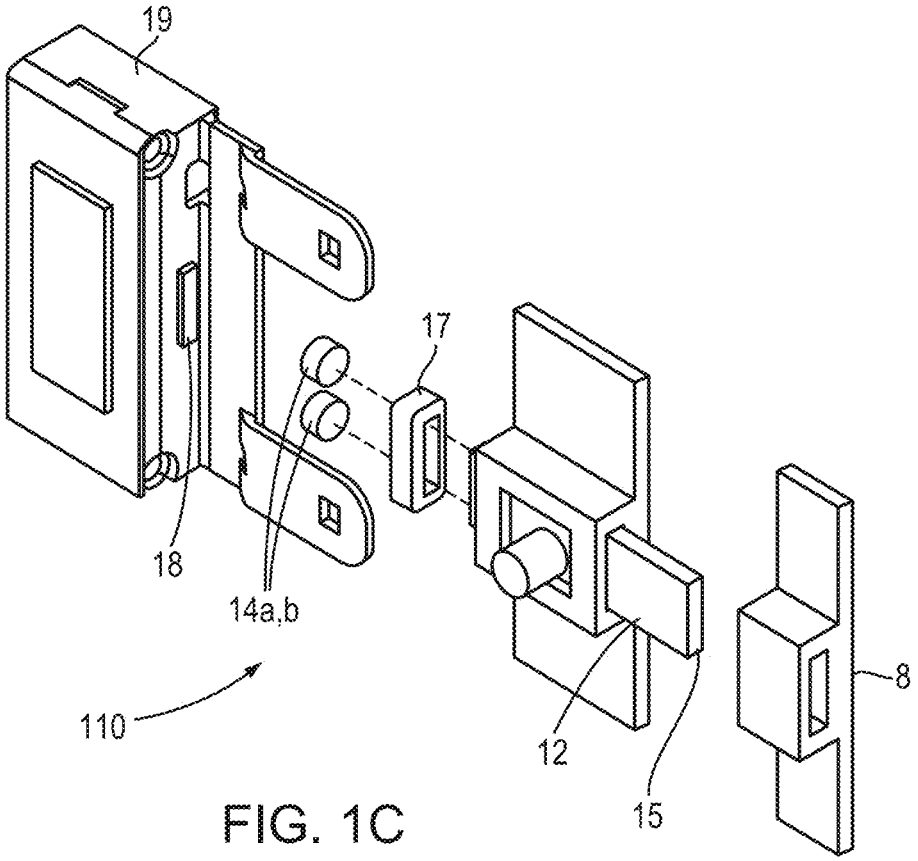
FIG. 1C is an exploded view of the device illustrated in FIG. 1B.
Figure 1D:
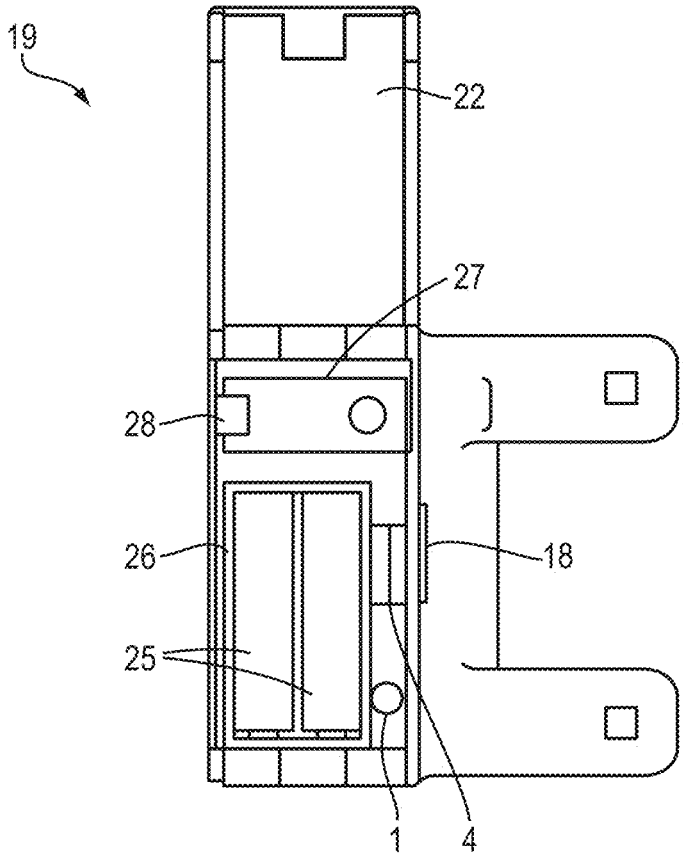
FIG. 1D is an open front view of an exemplary housing enclosing the electronic components of the locking mechanism illustrated in FIG. 1B.

Referring to FIGS. 1B-1D, the locking member 110 includes a slider 12, a housing 19 enclosing a sensor 4 for sensing slider position, a signal emitter 1 for transmitting a signal to the flush signal receiver 3 associated with the toilet flushing mechanism 112, a door housing controller 27, a battery compartment 26 enclosing one or more batteries 25, an SD card 28, and a cover 22. The locking member 110 further includes a lock chamber 6, positioned on a stall post 8. The lock chamber 6 is aligned with the slider 12.

Figure 2A:
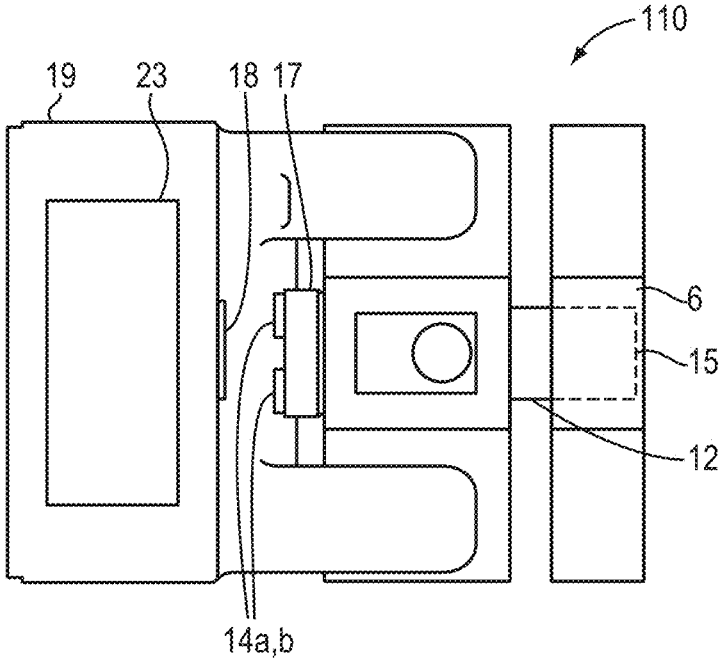
FIG. 2A illustrates an embodiment of the stall door slider lock in the closed (first) position of the embodiment of the toilet flushing system illustrated in FIG. 1B according to the invention.
Figure 2B:
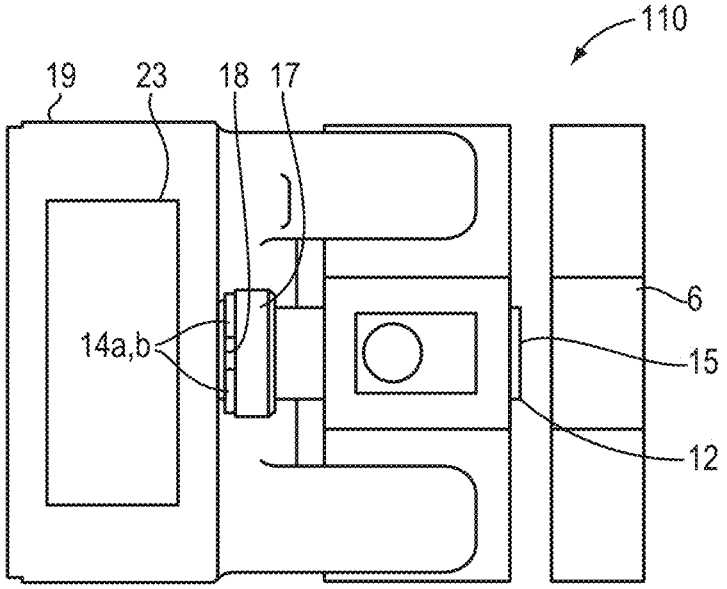
FIG. 2B illustrates an embodiment of the stall door slider lock in the open (second) position of the embodiment of the toilet flushing system illustrated in FIG. 1B.

Referring to FIGS. 2A and 2B, the slider 12 is capable of manual reciprocal movement between a first (closed) position and a second (open) position. In the first position, illustrated in FIG. 2A, proximal end 15 of the slider 12 is inserted in the lock chamber 6 when the stall door 100 is closed and locked. The proximal end 15 of the slider 12 cannot be inserted in the lock chamber 6 unless the stall door 100 is closed.

In the second position illustrated in FIG. 2B, the proximal end 15 of slider 12 that was inserted in the chamber 6 illustrated in FIG. 1A is positioned outside, i.e., free of, the lock chamber 6. In the second position, a distal end 17 of the slider 12 opposite to slider proximal end 15, contacts and/or is sensed by the sensor 4 initiating a signal from signal emitter 1 enclosed within the housing 19 (FIG. 1D) to emit a signal that is transmitted to flush signal receiver 3 positioned on the toilet or associated toilet plumbing when the stall door 100 is open.

Each time a stall door is unlocked by moving the slider 12 from the first position where proximal end 15 of the slider 12 is positioned in the lock chamber 6, to the second position where the proximal end 15 of the slider 12 is free of the chamber 6, the opposite distal end 17 of the slider 12 contacts and/or is sensed by the sensor 4. The sensor 4 upon contact with and/or sensing distal end 17 of slider 12 triggers the signal emitter 1 to send a wireless signal such as a radio frequency or Bluetooth® signal or a hardwire signal to the flush signal receiver 3 triggering the toilet flushing controller 16 operatively joined to the flushing actuator 5 on the toilet 7 to initiate a flush.

The sensor 4 can be a variety of different sensors or a combination of sensors. Examples of possible sensors include but are not limited to: contact sensors, magnetic proximity sensors, vibration sensors, infrared sensors, or ultrasonic sensors.

In one embodiment of the invention, a contact sensor 4 is positioned in or on the housing 19 or on the stall door 100 such that every time the slider 12 is transferred from the first position to the second position, the slider 12 makes physical contact with the sensor 4. Such contact signals flush actuation.

In another embodiment, a magnetic proximity sensor 4 positioned in or on the housing 19 or on the stall door 100 is used to detect the presence of a magnet or magnetized material, e.g. piece of metal 14*a,b* affixed to the slider 12. Upon transfer of the slider 12 to the second position, the magnet or magnetized piece of metal 14*a,b* triggers the magnetic proximity sensor 4, signaling flush actuation. The number of magnets or magnetized materials are not limited to those illustrated.

In still another embodiment, a vibration sensor 4, similar to the contact sensor, is positioned in or on the housing 19 or on the stall door 100 such that every time the slider 12 is transferred from the first position to the second position, the slider 12 makes physical contact with the sensor 4. The vibration sensor 4 detects the impact of the slider 12 signaling flush actuation.

In yet another embodiment, an infrared sensor 4 is affixed in or on the housing 19 or on the stall door 100. The infrared sensor 4 emits an infrared signal to detect the distance of nearby objects. The infrared sensor is attuned to detect the distance of the slider 12 from the sensor such that it triggers flush actuation upon the movement of the slider 12 from first position to second position.

In yet another embodiment, an ultrasonic sensor 4 is affixed in or on the housing 19 or on the stall door 100. The sensor 4 detects sound waves reflected back by nearby objects, thereby allowing the sensor to register distance. For example, the sensor 4 detects sound waves reflected back by slider 12 depending on the distance of the slider 12 from the sensor 4. Based on a predetermined distance between the slider 12 and the sensor 4, flush actuation would be initiated following translation of the slider 12 from the first position to the second position.

Each locking member signal emitter 1 is matched to a corresponding toilet flush signal receiver 3 and uses unique signals that differ from other of the signal emitters 1 and flush signal receivers 3 in other nearby systems 10, for example, other systems 10 in the same bathroom. By the application of unique signals, one signal emitter 1 is prevented from activating the flushing system of other toilets to flush.

In one embodiment of the invention, the system 10 further includes a toilet flushing actuator 5 that initiates a flush to occur in the toilet 7. The system 10 described herein could either be retrofitted to current toilets and bathroom stalls as an attachment or manufactured directly onto a new toilet and applied to bathroom toilet stalls or to pre-fabricated bathroom toilet stalls. In one implementation, the toilet flushing actuator 5 may be designed to fit over a manual another illustrative embodiment, the toilet flushing actuator 5 may be designed for mounting externally over existing toilet plumbing and configured to actuate an existing manual flush mechanism. This implementation, does not require water to be shut off to the system and does not directly interact with any flowing water, so there is less reliability risk of electronics being exposed to water. This embodiment of the toilet flushing actuator is comparatively easy and inexpensive to install to existing toilet installations without requiring a plumber to easy installation over existing manual flush mechanisms.

Embodiments that use an external implementation of the toilet flush controller 5 are not directly connected to the water supply flow, so they are unable to detect a continuous flush by interacting with the flow of water or based on signals from a flush actuator solenoid used in other embodiments, for example. However, in an illustrative embodiment the external implementation of the flush controller may include a sound sensor and/or an ultrasonic sensor to detect continuous flushes based on their sound pattern. A sound sensor and/or an ultrasonic sensor could be similarly implemented in other flush controller embodiments of the disclosed system in addition to or instead of other flow sensors.

Figure 3:
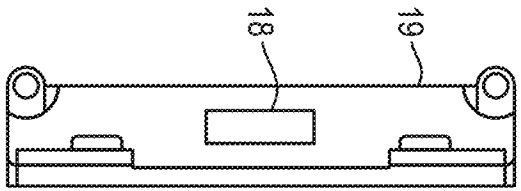
FIG. 3 illustrates a side view of the housing of the embodiment of the locking mechanism illustrated in FIG. 1B according to the invention.

FIG. 3 illustrates the location of a magnet or magnetizable plate 18 on the portion of the housing 19 that faces an end 17 of the slider 12 that is opposite to the insertable end 15 of the slider 12. The shape of the plate is not limited to the illustrated shape, as the shape could be rectangular, circular, triangular, trapazoidal or another shape. Magnetizable materials include but are not limited to iron, nickel, cobalt, rare-earth metals, and lodestone. The location of magnets or magnetizable materials and the number of magnets or magnetizable materials on the housing 19 are not limited to those illustrated.

Figure 4:
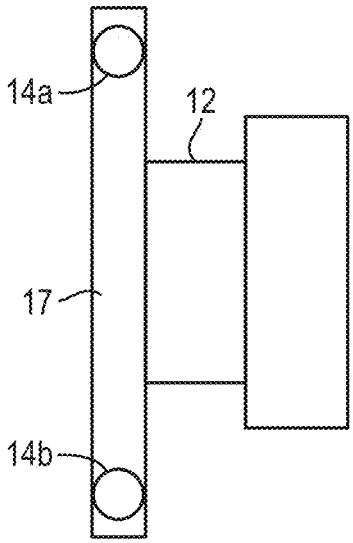
FIG. 4 illustrates a side view of a slider of the embodiment of the locking mechanism illustrated in FIG. 1B.

Referring now to FIG. 4, a side view of the slider 12 is illustrated. The location of slider magnets or magnetizable materials 14*a* and 14*b* on end 17 of slider 12 are positioned to magnetically interact with magnetic or magnetizable plate 18 on housing 19. The slider magnets or magnetizable materials 14*a* and 14*b* are aligned with the magnetic or magnetizable plate 18 of the housing 19 to (i) ensure that proper contact is made between the slider 12 and housing 19 such that the slider 12 is aligned with the sensor 4, (ii) prevent the slider 12 from bouncing back and forth upon the opening and closing of the stall door, and (iii) attract the slider 12 to the housing 19 in the event the user does not slide the slider 12 sufficiently towards the housing 19.

The strength of the magnets or magnetizable materials are sufficient to attract the slider 12 to connect to the housing 19 immediately upon unlocking, but not so strong that the magnets or magnetizable materials prevent the slider 12 from reaching its extended locked position. The housing 19 and lock slider 12 are either at a predetermined or adjustable distance away from each other such that immediately upon unlocking, i.e., immediately upon moving the slider 12 from the first position illustrated in FIG. 2A to the second position illustrated in FIG. 2B, the magnets or magnetizable materials 14*a* and 14*b* of slider 12 contact the magnets or magnetizable materials 18 of the housing 19. This avoids the possibility that when the user unlocks the stall door 100 the slider 12 will not move all the way into the second position, preventing the slider 12 from initiating the process for the signal emitter 1 to emit a signal to be received by the flush signal receiver 3 to initiate the events leading to a flushing. In other words, by fully reaching the second position, which is ensured with the magnets, the sensor 4 adequately senses the presence of the slider 12 in the second position so that a flush signal is emitted by signal emitter 1 to flush signal receiver 3, regardless of the type sensor, for example, the sensors disclosed above, that is being used.

The electronic circuitry for the electronic components inside the housing 19 may be powered by either one or more photovoltaic cells 23 or by one or more batteries 25 housed in housing 19, for example. The electronic circuitry for the flushing mechanism 112 including the flush signal receiver 3, the toilet flushing controller 16, and the toilet flushing actuator 5 may be powered by either one or more photovoltaic cells or by one or more batteries.

In one embodiment of the invention, the toilet flushing controller 16 and/or the door housing controller 27 is configured to implement a programmable time delay that is introduced to set minimum intervals between flushes, preferably ranging from, but not limited to, 1-5 seconds, 1-10 seconds, 5-25 seconds, 5-50 seconds, 25-50 seconds, 50-100 seconds, 100-200 seconds, 150-250 seconds, preferably, 5 to 240 seconds. The programmable time delay setting minimum intervals between flushes may also be set to be less than 5 seconds or more than 240 seconds. The programmable time delay can be manually programmed, or determined through an algorithm that uses machine learning or deep learning techniques to determine an optimal time interval. The programmable time delay prevents users from repeatedly flushing the toilet in short intervals of time by repeatedly switching the slider 12 of the stall locking member 110 back and forth between locked (first position) and unlocked positions (second position). Managers of the bathroom will be able to manipulate the time delay range at their discretion with a system controller 114 for example, a computer, a mobile application, or a combination of various electronics and/or computer based technology.

In one embodiment, a system controller 114 may be specific to one toilet, alternatively to all the toilets in the same bathroom, or central to all the toilets in the entire building, but with the ability to regulate the time delay in each or every individual toilet.

In a particular embodiment, a different time delay may be appropriate for a handicap toilet as opposed to a regular toilet because the handicap toilet may be used differently from a non-handicap toilet. The system controller 114 measures how many times the toilets flush, allowing the facility manager to collect data and adjust settings to maximize water efficiency. The system controller 114 sends data to the flush signal receiver wirelessly via Bluetooth® or radio frequency, for example. Also a required daily flush for toilets that were not used can be programmed into the system 10 to keep toilets clean. The system controller 114 records the frequency of slider operation, and optionally may record and store additional functional data and timestamps relating to any action of the system or signals generated by the system, for example.

Figure 5:
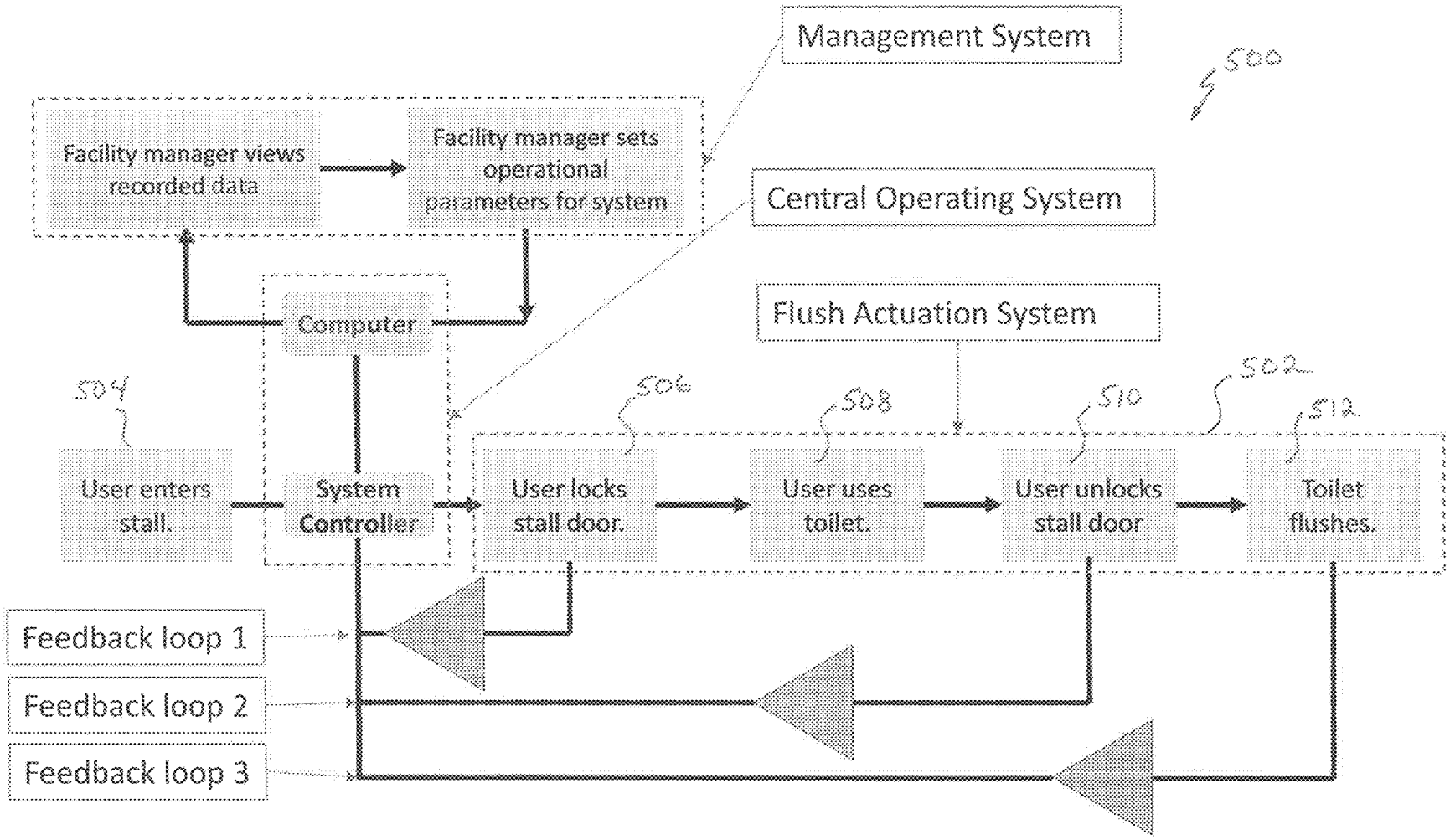
FIG. 5 is a process flow diagram showing a method of providing information for managing facilities toilet flushing according to an aspect of the present disclosure.

A method for automatically actuating a toilet flush using a flush actuating system according to an embodiment of the present disclosure is described with reference to FIG. 5. According to an aspect of the present disclosure, the system may be programmed and/or configured such that unlatching of a stall door sends a wireless signal to the toilet flush controller that triggers the toilet flushing actuator to initiate a flush. In an illustrative embodiment of the disclosed system and method, an ordinary usage cycle 502 begins when a user enters a toilet stall 504, then the user locks the door 506, then the user uses the toilet 508, then the user unlocks the door 510, then the user leaves the stall. During the ordinary usage cycle, the unlocking of the stall door 510 by the user triggers a flushing of the toilet 512. The ordinary cycle is effective as a substantial water saving technique.

According to another aspect of the present disclosure, the disclosed system and method can be programmed and/or configured to tolerate and/or accommodate toilet stall uses that do not include the ordinary usage cycle. For example, on some occasions, a user only uses a toilet stall to change clothes without using the toilet. On other occasions a male user may choose to refrain from latching the stall door in order to use the toilet as if it were a urinal, for example. On other occasions a user who may not be aware that the stall door latch initiates flushing may intentionally trigger a manual flush. On other occasions maintenance workers may trigger manual flushes to clean the toilet, for example.

In this illustrative embodiment, the flush actuating system includes a distance sensor in communication with programmable logic circuitry configured to recognize and accommodate toilet stall uses that do not include the ordinary usage cycle. This adaptation to the ordinary usage cycle system and method substantially improves water savings and facilitates improved management techniques. In an illustrative embodiment, the distance sensor and programmable logic circuit functionality adaptation can be enabled or disabled by facility managers, for example.

According to aspects of the invention, timestamps may be recorded by the feedback loops upon recognition of certain events. An identification of the type of event that occurred may be recorded by the feedback loops along with a corresponding time stamp.

Some events such as "user does not lock stall door," which falls in the category of events occurring during feedback loop 1, are not necessarily recorded by feedback loop 1. However, such events may be recognizable by their absence upon the occurrence of an event that usually follows, such as the occurrence of feedback from subsequent feedback loops 2 and 3, for example. In such cases the event may be retroactively recorded by the system. If this is a frequent occurrence of this event, then the facility manager may be alerted to the fact that it is consistently not receiving feedback from feedback loop 1, for example.

Similarly, while a "toilet does not flush" event may not actively trigger the transmission of a signal in feedback loop 3, the absence of an expected "toilet flushes" event after a "user presses opt-out button" event may be noted after a certain period of time, for example.

According to another aspect of the present disclosure the ordinary user cycle may be supplemented or adapted to accommodate various system faults. In a first example of system fault handling according to an aspect of the present disclosure, a system fault may occur when one or more component of the system stop working. In this situation, the system controller may detect that it is only receiving information from feedback loop 2 and feedback loop 3, but not from feedback loop 1, for example. The computer may be configured to recognize when it is not receiving signals from all feedback loops and, in response to sends an alert to a platform having a user interface with which the facility manager views the data. The alert may include an identification of the suspected fault type and a time stamp of the fault recognition.

In a second example of system fault handling according to an aspect of the present disclosure, a system fault may occur when all components of the system fail. In an illustrative embodiment, the computer continuously stores data as it is received from the feedback loops. An algorithm executing on the computer sorts data indicating frequency of flushes data into multiple time buckets. The time buckets may include hours, days, weeks, months, and years, for example. In the illustrative embodiment, the computer then can compute the frequency of new flushes within each bucket and compare the computed frequency against historical data for the same time bucket. For example, the computer may compute whether the current frequency is within, higher, or lower than percentage range of the historical value. According to an aspect of the present disclosure, the percentage range is selectable by the facility manager. The system notifies the facility manager when the current frequency is outside of the selected range, for example.

When none of the feedback loops are providing signals, the computer determines that the frequency of flushes is 0%. If this frequency is consistent for a predetermined time interval, during which historical data indicates that there should be a much higher frequency of flushes, then the facility manager is automatically notified. This fault handling system and method enables the facility manager to perform timely checks on the devices in the corresponding stall. In an illustrative embodiment, the facility manager can program and/or configure the system to vary the time buckets during which the frequency determination and fault analysis will occur or the computer may be programmed to automatically complete this process, for example.

In a third example of system fault handling according to an aspect of the present disclosure, a system fault may be recognized when one component signals more frequently than expected. According to an aspect of the present disclosure, the system controller can compare the frequency of signals received within a specified time bucket from any and all feedback loops to the historical data. When a notable discrepancy from the expected results is recognized, such as numerous toilet flushes recorded for only one user lock and unlock sequence, the system controller captures the pertinent data and send it to the computer. The computer can then communicate an appropriate and specific fault alert to the facility manager.

In a fourth example of system fault handling according to an aspect of the present disclosure, a system fault may occur when one component signals unexpectedly. When the system controller receives signals out of order, such as a toilet flushing before a user locks or unlocks the door, then the system can send a signal to the computer to alert the facility manager. This can be especially useful information for facilities managers to quickly recognize and repair a toilet that is continuously flushing and wasting a large amount of water. According to an aspect of the present disclosure such continuous flushing is quickly recognized base on constant feedback signals being sent to the system controller.

According to an aspect of the present disclosure, a variety of alerts may optionally be communicated to facility managers. The alerts provided extensive insight regarding real-time and historical functionality of system components and overall bathroom usage. The alerts can be managed by the facilities manager on a user interface of the system controller, or of a platform in communication with the system controller.

According to another aspect of the present disclosure, facility managers can view toilet flushing records for daily, weekly, monthly, yearly or multiple year periods to determine patterns for best managing toilet flushing, for example. This information can be useful to identify times when a toilet has historically not been flushed, e.g., when the facility is closed. In such cases, the facility manager can schedule a sentinel flush to occur then so as to ensure it does not happen when a user is present. "Sentinel flush" is an industry standard term that refers to an automatic flush that is programmed to occur in order to keep a toilet clean.

In another example where such data can be useful, the data may allow a facilities manager to recognize when a flushing mechanism was not strong enough to eliminate solid waste. In such cases, the data may indicate that multiple users have manually flushed before using the toilet, and flush again when they leave. If this pattern persists or increases over time, The facility manager can recognize that a problem with a flushing mechanism exists and can then perform a timely replacement or adjustment of the flushing mechanism for example.

In another illustrative embodiment, during ordinary system operation facilities managers can configure the system to display the real time or historic frequencies at which signals from feedback loops 1-3 are recorded. The frequencies can be displayed numerically or graphically, for example, and can be sorted by building, bathroom, or by specific toilet/stall. They can also sort between real time and historical recordings.

In another illustrative embodiment, during ordinary system operation, facilities managers can configure the system to provide notification of time periods during which frequency of usage is higher or lower than other periods.

In another illustrative embodiment, during ordinary system operation facilities managers can configure the system to display, or the system may be configured to automatically display a notification of low battery life for any of the system components. For example, the system may indicate that battery life is low for any component, that component must be replaced in a particular number of days, that that the battery is dead, so the component may be recharged or the battery may be replaced at an appropriate time.

In another illustrative embodiment, during ordinary system operation facilities managers can configure the system to display, or the system may be configured to automatically display a notification of an unexpected signal or signal sequence. For example, the system can provide a notification when the system controller does not receive feedback loops 1, 2 and 3 in order. In another example, the system controller may provide a notification when it receives multiple signals from feedback loops 1, 2 or 3 within a single usage cycle. In another example, the system may provide a notification when the system controller is not consistently receiving signals from any or all of the feedback loops. Occurrences of unexpected signals or signal sequences can be recorded and frequencies of such occurrences can be displayed to a facilities manager, for example.

According to aspects of the present disclosure, facility managers are enabled to respond to certain alerts remotely. Such remote responses can shorten response time and limit the possibility of a catastrophic issue occurring from any of the technology. For example, according to an aspect of the present disclosure, a facilities manager can program the system controller, via a computer in communication with the system controller, for example, to set system parameters and control system functionality. Some programming capabilities of a facilities manager according to aspects of the present disclosure include: preventing flushes, delaying flushes, actuating flushes, reducing flush volume, preventing usage of a stall, and/or controlling alerts, for example.

Although the term facilities manager is used throughout the present application to describe the entity who is responsible for operating and managing the disclosed system, it should be understood that such an entity may not necessarily have a title or function as a facilities manager. Persons skilled in the art should appreciate that in some implementations of the disclosed system persons other than a facilities manager, including virtually any authorized user may operate the system. The authorized user may be a facilities employee or a remote service provider, for example.

In an illustrative embodiment, a facilities manager can program the system to prevent flushes by programming the toilet flush controller to stop signaling the toilet flushing actuator to actuate a flush. Alternatively, or in addition, the facilities manager can also program the system to prevent flushes by programming the door housing controller to stop signaling the signal emitter to emit signals to the flush signal receiver. According to an aspect of the present disclosure, preventing flushes can be implemented manually at virtually any time, or the facility manager may set times for this to occur at regular intervals, for example. This programmable functionality to prevent flushes can be used to set long term intervals of when a toilet should not flush, for example when a building is closed at night, the facility manager may want to shut-off flushing functionality during that time. The facility manager can also set this to occur after specific types of feedback, such as, but not limited to, an absence of signal from a specific feedback loop In an illustrative embodiment, a facilities manager can program the system to cause the toilet flush controller to signal the toilet flushing actuator to actuate a flush. Alternatively or in addition, the facilities manager may program the system controller to have the door housing controller signal the signal emitter to emit a signal to the flush signal receiver to actuate a flush. According to an aspect of the present disclosure, actuation of flushes can be performed manually at any time, or the facility manager may set times for this to occur at regular intervals, for example.

In an illustrative embodiment, a facilities manager can program the system to set a default flush volume for ordinary operation, set a specific flush volume and a period of time for which the toilets should flush at that volume In an illustrative embodiment, the system may be configured to allow a facility manager to remotely manipulate the position of the stall latch slider to prevent it from locking or unlocking, for example. This functionality may be implemented when a facility manager notices unusual activity, but does not have time to immediately address the problem. In this embodiment, the system controller may instruct the door locking chamber to prevent the slider from achieving the locked position, for example. This would prevent the user from being able to lock the stall and achieve privacy, therefore subtly discouraging them from using the stall.

Alternatively the system may be programmed to cause the housing to interfere with the slider travel and thereby to prevent the slider from reaching an unlocked position, for example.

In another illustrative embodiment, the system controller may be programmed to delay flushes by setting a selected time interval beginning after the instance of a flush, during which the system prevents another flush from occurring until the time interval has passed, for example. In yet another illustrative embodiment, the facility manager can set notifications to be received when a specific percentage threshold of expected, or unexpected, flushes occur within a time bucket, for example.

In several situations, toilets do not need to flush at their normal volume. In these situations flushing with normal flush volumes wastes a substantial volume of water. An illustrative embodiment of the present disclosure includes proactive methods for reducing flush volume. According to this embodiment, the system is configured so that a toilet bowl will initially have a lower flush volume than necessary. The system then reacts to adjust the flush volume based on user activity. In one example, this functionality may be useful at times of high facilities usage, such as during halftime of a sporting when urinal overflow often leads to toilets in stalls being used urinals. According to an aspect of the present disclosure, a facility manager can program the system controller in such instances in order to temporarily lower the flush volume of each toilet to save water, then return the flush volume to ordinary levels after half time. According to another aspect of the present disclosure, a facility manager could also program the system controller through the management system to initiate a flush of all the toilets at once, for example at the end of half time.

In another illustrative embodiment of the present disclosure, a toilet can be set to constantly operate at a reduced flush volume unless if a user locks the stall, as in these cases the user is more likely to use the toilet to defecate instead of urinate. In an illustrative embodiment, when the signal emitter detects the slider in locked position or transitioning to the locket position, the signal emitter transmits to the original receiver and thereby command the toilet flushing controller to increase the flush volume back to ordinary levels.

According to an aspect of the present disclosure, the facility manager can optionally trigger reduced volume flushes for selected times or ranges of times, such as single instances, during a selected time interval, at regular time intervals, or automatically based on user actions for example. A wide range of flush volumes can be triggered for particular times or conditions. In an illustrative embodiment, the flush volume may be set from 0 gallons to 5 gallons of water, for example. Alternatively, the flush volume can be controlled based on an amount of water that is allowed to enter the bowl, and/or an amount of water that is used to flush. Flush volume can also be recorded during the feedback loops, for example.

What is claimed:

1. A system for managing toilet flushing in a bathroom stall, comprising:

a door housing controller comprising, a door lock chamber, a slider capable of translating from a first position to a second position, the slider comprising a first end and a second end opposite the first end, wherein the slider first end in the first position is inserted in the door lock chamber and the slider first end in the second position is free of the door lock chamber, a signal emitter configured to send a wireless signal to a flush signal receiver when the slider is in the second position, a sensor configured for sensing the slider when the slider is in the second position, the sensor operatively connected to the signal emitter;

(ii) a toilet flushing controller operatively joined to the flush signal receiver;

(iii) a toilet flushing actuator controlled by the toilet flushing controller, wherein, the signal emitter is configured to transmit to the flush signal receiver a signal upon sensing that the slider has been translated to the second position, the toilet flushing controller configured to control the toilet flushing actuator to initiate a single toilet flush when the door is unlocked; and (iv) a system controller in communication with the toilet flushing controller and the door housing controller, wherein the system controller also receives and also analyzes, records and/or provides one or more instructions based on one or more corresponding signal patterns from both the toilet flushing controller and the door housing controller;

wherein the system controller is configured to output a specific fault notification in response to the corresponding signal pattern received from the toilet flushing controller and the door housing controller.

2. The system as recited in claim 1 wherein the specific fault notification includes a time stamp identifying a time that the corresponding signal pattern was received by the system controller.

3. The system as recited in claim 1 wherein the system controller is configurable by an authorized user to cause the system to output one or more selected types of fault notifications corresponding to different type of system faults that are identifiable by system in response to corresponding signal patterns.

4. The system as recited in claim 3 wherein the system controller is configured to output a malfunctioning component fault notification in response to receiving signals from one or more sensors in a sequence associated with another sensor, without receiving an anticipated signal from the other sensor.

5. The system as recited in claim 3 wherein the system controller is configured to sort frequency of flush information into a plurality of time buckets.

6. The system as recited in claim 5, wherein the system controller is configured to compute a frequency of flushes within each of the time buckets and compare the computed frequency to historical frequencies for the corresponding buckets.

7. The system as recited in claim 6 further comprising determining that the frequency of flushes for one or more buckets is outside a predetermined frequency range.

8. The system as recited in claim 7, further comprising outputting a notification indicating that the frequency of flushes in outside of the predetermined range.

9. A method for managing toilet flushing in a bathroom stall, comprising:

outputting by a toilet flushing system, a specific fault notification in response to a corresponding signal pattern received from a toilet flushing controller and a door housing controller of the toilet flushing system; wherein the toilet flushing system comprises:

(i) the door housing controller comprising a door lock chamber, a slider capable of translating from a first position to a second position, the slider comprising a first end and a second end opposite the first end, wherein the slider first end in the first position is inserted in the door lock chamber and the slider first end in the second position is free of the door lock chamber, a signal emitter configured to send a wireless signal to a flush signal receiver when the slider is in the second position, a sensor configured for sensing the slider when the slider is in the second position, the sensor operatively connected to the signal emitter;

(ii) the toilet flushing controller operatively joined to the flush signal receiver;

(iii) a toilet flushing actuator controlled by the toilet flushing controller, wherein, the signal emitter is configured to transmit to the flush signal receiver a signal upon sensing that the slider has been translated to the second position, the toilet flushing controller configured to control the toilet flushing actuator to initiate a single toilet flush when the door is unlocked; and (iv) a system controller in communication with the toilet flushing controller and the door housing controller, wherein the system controller also receives and also analyzes, records and/or provides one or more instructions based on one or more corresponding signal patterns from both the toilet flushing controller and the door housing controller.

10. The method as recited in claim 9 wherein the specific fault notification includes a time stamp identifying a time that the corresponding signal pattern was received by the system controller.

11. The method as recited in claim 9 wherein the system controller is configurable by an authorized user to cause the system to output one or more selected types of fault notifications corresponding to different type of system faults that are identifiable by system in response to corresponding signal patterns.

12. The method as recited in claim 11 wherein the system controller is configured to output a malfunctioning component fault notification in response to receiving signals from one or more sensors in a sequence associated with another sensor, without receiving an anticipated signal from the other sensor.

13. The method as recited in claim 11 wherein the system controller is configured to sort frequency of flush information into a plurality of time buckets.

14. The method as recited in claim 13, wherein the system controller is configured to compute a frequency of flushes within each of the time buckets and compare the computed frequency to historical frequencies for the corresponding buckets.

15. The method as recited in claim 14 further comprising determining that the frequency of flushes for one or more buckets is outside a predetermined frequency range.

16. The method as recited in claim 15, further comprising outputting a notification indicating that the frequency of flushes is outside of the predetermined range.

* * * * *